US005344354A

United States Patent [19]

Wiley

[11] Patent Number: 5,344,354

[45] Date of Patent: Sep. 6, 1994

[54] FLIGHT-SIMULATING AIRPLANE TOY

[76] Inventor: Larry Wiley, 1211 South Jose Dr., Tucson, Ariz. 85713

[21] Appl. No.: 54,100

[22] Filed: Apr. 30, 1993

[51] Int. Cl.[5] ..... A63H 17/00; A63H 27/00

[52] U.S. Cl. ..... 446/7; 446/230

[58] Field of Search ..... 446/7, 30, 31, 32, 63, 446/65, 230, 231, 232, 228

[56] References Cited

U.S. PATENT DOCUMENTS

| | | | |
|---|---|---|---|
| 2,454,693 | 11/1948 | Foster | 446/7 |
| 3,010,718 | 11/1961 | Pearson, Jr. . | |
| 3,101,569 | 8/1963 | Giardina | 446/230 |
| 3,332,682 | 7/1967 | Schuller | 446/7 X |
| 3,691,669 | 9/1972 | Folson et al. . | |
| 3,800,467 | 4/1974 | Brenner | 446/7 |
| 4,160,339 | 7/1979 | Dankman et al. . | |
| 4,269,596 | 5/1981 | D'Andrade | 446/7 X |
| 4,421,485 | 12/1983 | Geschwender . | |
| 4,604,075 | 8/1986 | Richards et al. . | |
| 4,793,610 | 12/1988 | Moomaw et al. | 446/7 X |
| 4,850,922 | 7/1989 | Harris . | |
| 4,889,514 | 12/1989 | Auer et al. . | |
| 4,897,065 | 1/1990 | Fertig et al. | 446/63 |

FOREIGN PATENT DOCUMENTS

| | | | |
|---|---|---|---|
| 54970 | 6/1951 | France | 446/7 |
| 1063426 | 12/1983 | U.S.S.R. | 446/230 |
| 2239816 | 7/1991 | United Kingdom | 446/87 |

*Primary Examiner*—Robert A. Hafer
*Assistant Examiner*—D. Neal Muir
*Attorney, Agent, or Firm*—Antonio R. Durando; Harry M. Weiss

[57] ABSTRACT

A flight-simulating airplane toy that consists of a two-handle control grip resembling a conventional cockpit control yoke comprising a forward-projecting shaft upon which a model aircraft is removably mounted. The shaft is rotatably journaled on a bearing in the front of the grip and is driven by a reversible motor actuated by control switches in the handles that permit a user to rotate the shaft clockwise or counterclockwise, thus simulating an aircraft roll in either direction as the grip is held stationary. The proximal end of the shaft is fitted with radial arms that are visible through a window in the grip, thus providing a bank indicator for the position of the craft with respect to the ground. The same grip can be used with different airplane models by replacing planes through a connection of the distal end of the shaft with a longitudinal opening along the back side of the plane.

15 Claims, 2 Drawing Sheets

FLIGHT-SIMULATING AIRPLANE TOY

RELATED DOCUMENTS

This invention is related to the disclosure contained in Disclosure Document No. 298993, filed on Jan. 27, 1992, by the same inventor.

BACKGROUND OF THE INVENTION

1. Field of the Invention

This invention is related in general to the field of toy airplanes and, in particular, to hand-held toys for simulating airplane rolls and other flight maneuvers.

2. Description of the Related Art

Since the inception of aviation, people have enjoyed model airplanes and children have played with toy airplanes to simulate flight conditions. Toys have been produced that simulate battle maneuvers, generating noises and launching projectiles for the entertainment of users. Radio-controlled toy aircraft have also been developed, so that a user can fully experience the excitement and risks of maneuvering a flying airplane. Because of the difficulty and potential danger involved, though, radio-controlled toys are normally not accessible to children. Therefore, toy manufactures have produced various hand-propelled toys for children's enjoyment.

In U.S. Pat. No. 3,010,718 (1961), Pearson describes a toy airplane featuring simulated sound and light displays actuated by controls in two handles under the back portion of the airplane. The toy is maneuvered by holding on to the two handles and by simulating the various motions, such as rolls and the like, of an airplane in action. By pressing on triggers on the handles, flight noises and light displays are emitted. In addition, simulated rockets may be launched from the wings of the plane.

U.S. Pat. No. 3,691,669 to Folson et al. (1972) discloses a toy-airplane display-stand/flight-simulator combination using a mechanical joy stick to control the movement of the plane mounted on the stand. The plane's support is mechanically linked to the stick in such a way that it can be maneuvered by moving the stick in all directions. The gist of the invention is in the particular linkage used to transmit motion to the plane.

U.S. Pat. No. 4,160,339 to Dankman et al. (1979) shows an electrical device to reproduce realistic sounds typical of a flying airplane. The sound effect generator is designed to recreate the sound of an airplane flying at different altitudes. The device is also capable of simulating the noise made by weaponry being fired.

In U.S. Pat. No. 4,421,485 (1983), Geschwender describes a flight simulator for model airplanes. The command levers on the simulator's control panel are mechanically connected to the airplane, so as to impart on it the same control functions that would result from the same lever motion on an actual flight control panel.

U.S. Pat. No. 4,604,075 to Richards et al. (1986) discloses a control unit for a helicopter. The unit is self-contained and can be used for remote control through an umbilical cord connecting it to the drive mechanisms in the helicopter. The toy can also be operated while being hand-held or left to itself on a level surface.

U.S. Pat. No. 4,850,922 to Harris (1989) describes a flight simulator toy worn on the chest of a child. The toy includes an airplane mounted on a straight shaft protruding forward and a handle used by the child to manipulate the position of the craft to simulate flight.

Because the airplane is removable from the shaft, different models of aircraft can be substituted and each model can also be used independently.

Finally, U.S. Pat. No. 4,889,514 to Auer et al. (1989) describes a hand-propelled toy airplane (or other vehicle) with a system of blinking lights actuated by a user. The motion of the toy airplane, while pushed on a flat surface, causes its wheels to act as an intermittent switch for a set of lights powered by a battery in the vehicle.

In order to simulate a rolling maneuver, all of these toy airplanes require that a user manipulate either the craft or a handle attached to it by twisting wrists and arms in the process, as children are often known to do. These actions detract from a realistic flight simulation and do not permit certain maneuvers that require multiple spins, such as screw and tumble falls, and multiple-point rolls.

Therefore, there is still a need for an improved aircraft toy that allows the simulation of these maneuvers with a hand-held apparatus that does not require twisting and turning of a user's wrists or arms. The present invention is directed at providing a toy airplane connected to a grip that allows a user to rotate and spin the airplane in either direction around a forward-projecting shaft while the grip is held in the air in a flight-simulation posture.

SUMMARY OF THE INVENTION

One objective of this invention is the development of a hand-held toy-airplane assembly that can be used by a child to simulate an airplane's aerobatic rolls, spins and dives without requiring the twisting and rolling of the child's wrists and arms.

Another goal of the invention is an assembly that consists of a model airplane mounted on a driving grip whereby a user can cause the plane to rotate about a forward projecting axis by actuating control switches in the grip.

Yet another goal of the invention is an assembly that permits the use of the hand-held control grip with a multiplicity of airplane models that can be interchangeably mounted on the grip.

Still another objective is a system of simulation control that is suitable for visual and audio displays as well as for aerobatic maneuver simulation.

A final objective is the easy and economical manufacture of the apparatus according to the above stated criteria.. This is achieved by using commercially available components and materials, modified only to the extent necessary to fit the requirements of the invention. Therefore, according to these and other objectives, the present invention consists of a two-handle control grip resembling a conventional cockpit control yoke and comprising a forward-projecting shaft upon which a model aircraft is removably mounted. The shaft is rotatably journaled on a bearing in the front of the grip and is driven by a reversible motor actuated by control switches in the handles that permit a user to rotate the shaft clockwise or counterclockwise, thus simulating an aircraft roll in either direction as the grip is held stationary. The proximal end of the shaft is fitted with radial arms that are visible through a window in the grip, thus providing a bank indicator for the position of the craft with respect to the ground. The same grip can be used with different airplane models by replacing planes through a connection of the distal end of the shaft with a longitudinal opening along the back side of the plane.

Various other purposes and advantages of the invention will become clear from its description in the specification that follows and from the novel features particularly pointed out in the appended claims. Therefore, to the accomplishment of the objectives described above, this invention consists of the features hereinafter illustrated in the drawings, fully described in the detailed description of the preferred embodiments and particularly pointed out in the claims. However, such drawings and description disclose only some of the various ways in which the invention may be practiced.

DESCRIPTION OF THE PREFERRED EMBODIMENT

The most important inventive feature of the apparatus of this invention relates to a rotating shaft on which a model airplane can be mounted to simulate the rolling of the craft during flight. With a single component, the shaft provides a means for rotating the plane and a means for simulating a bank indicator on a control panel. A yoke-like two-handle grip provided to support the plane further contributes to the simulation of realistic flight conditions.

Figure 1:
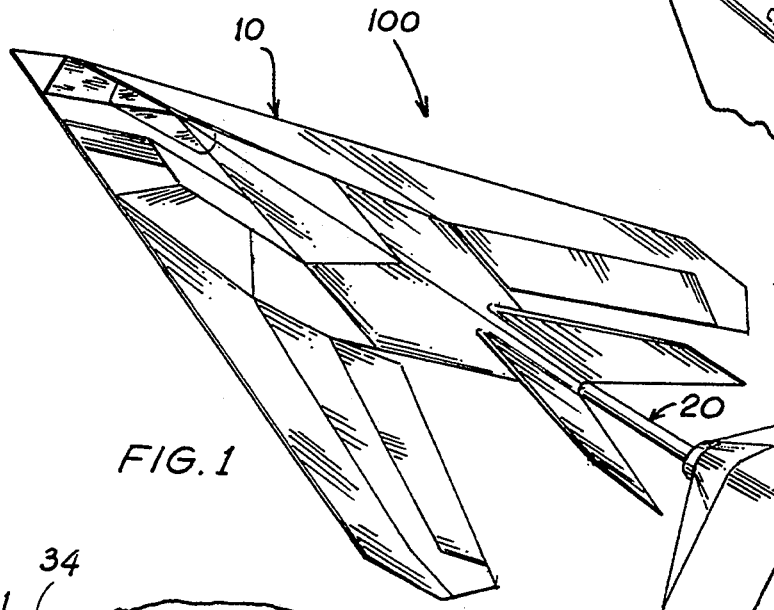
FIG. 1 is perspective view of a flight-simulating airplane toy illustrating a model airplane mounted on a two-handle control grip according to the preferred embodiment of the invention.

Referring to the drawings, wherein like parts are designated throughout with like numerals and symbols, FIG. 1 illustrates the flight-simulating airplane toy 100 of the invention in perspective view. The toy comprises a model airplane 10 (shown as a Stealth fighter for illustration) removably mounted on a straight shaft 20 projecting forwardly from a two-handle control grip assembly 30. The grip consists of two handles 32 disposed several inches apart from one another in a manner consistent with providing a toy simulating a control yoke in an airplane. Typically, the handles 32 are spaced 4 to 6 inches apart for a comfortable grip by an average-size child, but this dimension is not critical to the operation of the invention so long as the grip can be held steady without much effort during use.

Figure 2:
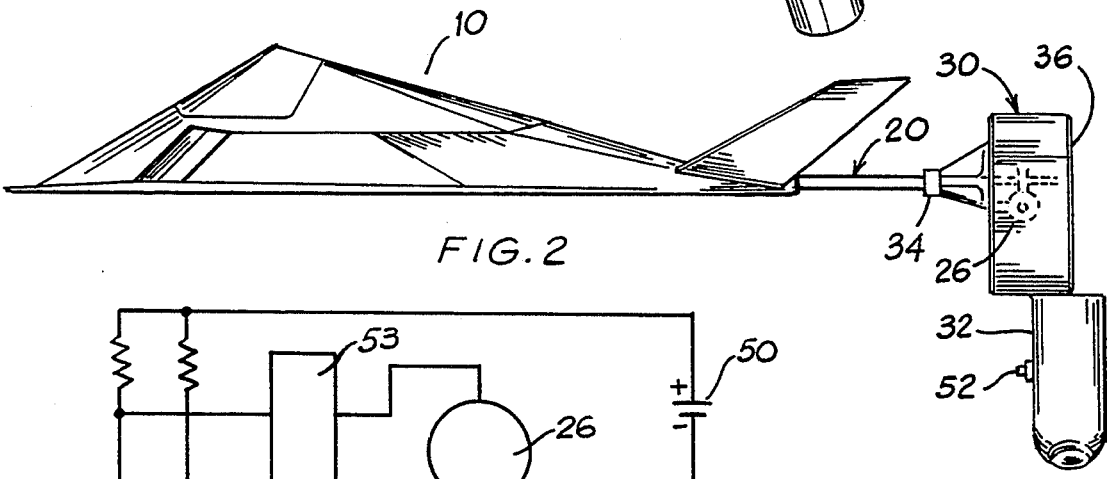
FIG. 2 is a side elevational view of the toy of FIG. 1.

The shaft 20 is rotatably mounted on the grip assembly 30 by means of a bearing 34 placed between the handles 32 in the front side of the housing 36 of the grip assembly for even weight distribution, as shown in the side elevational view of FIG. 2. The distal portion 21 of the shaft 20 protrudes forward from the bearing 34, while the proximal portion 23 protrudes backwards and is fully contained within the housing 36. As illustrated in the enlarged cut-out view of FIG. 3, the proximal portion of the shaft 20 is fitted with a coaxial drive gear 22 that is engaged by a tangential continuous worm-screw drive 24 connected to a reversible electric motor 26 anchored to the interior wall of the housing by means of a supporting brace 37. Thus, the shaft 20 is rotatably supported by the portion 25 of the shaft that is journaled in the bearing 34 and is capable of rotating in either direction depending on the direction of rotation of the reversible motor 26.

Figure 4:
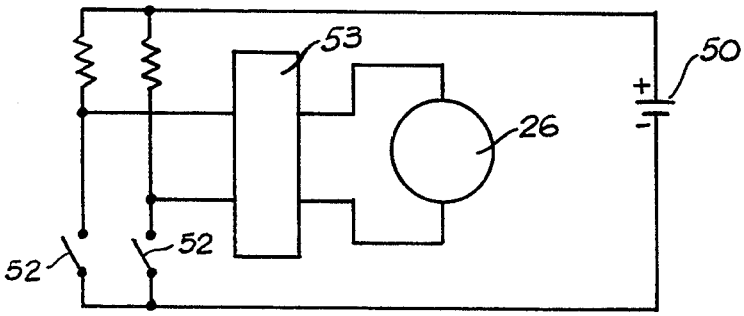
FIG. 4 is a schematic representation of the electronic circuit used to control the movement of the airplane of the invention.
Figure 6:
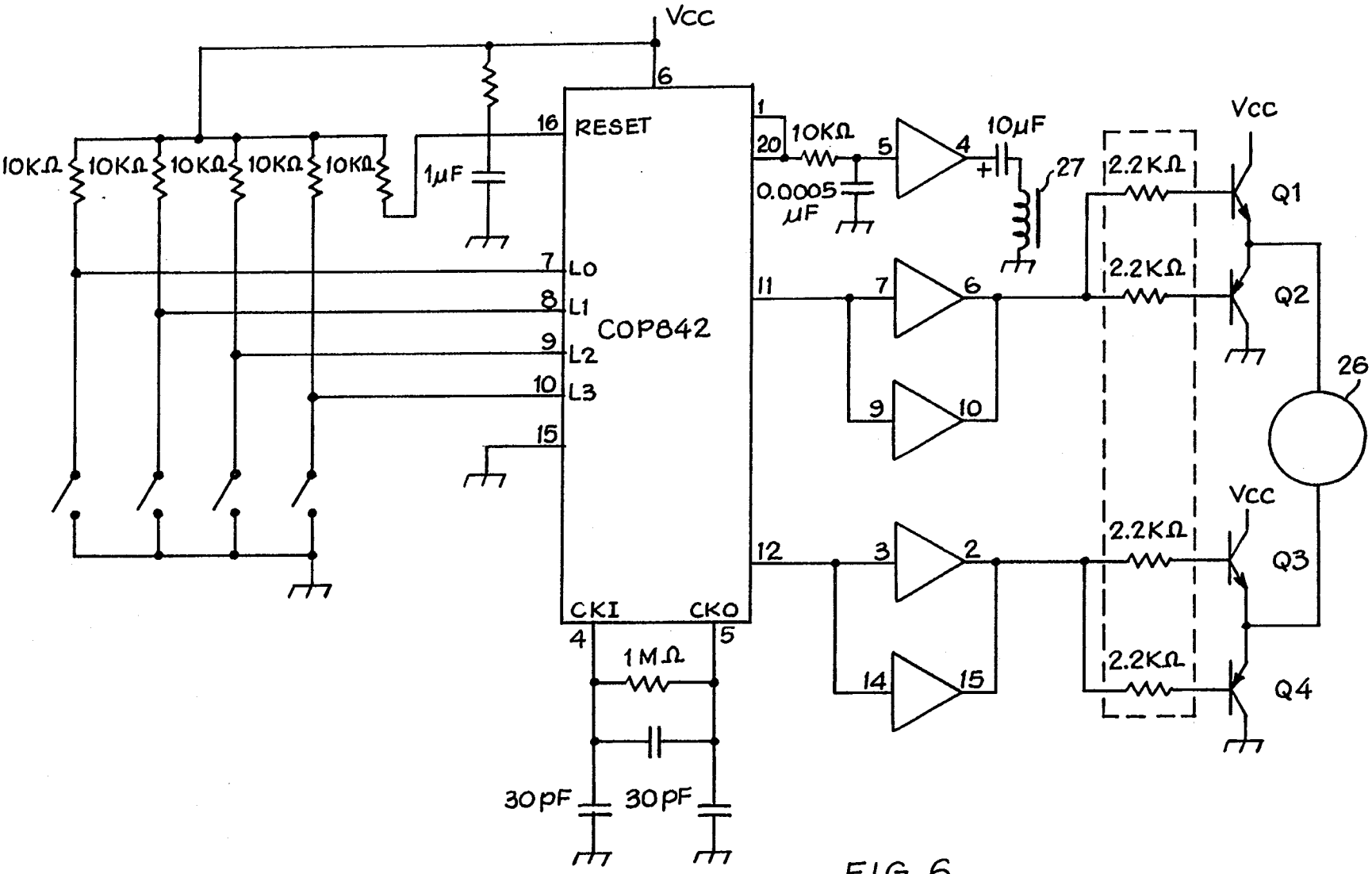
FIG. 6 is a more detailed schematic of the electronic circuit shown in FIG. 4.

The reversible motor 26 is preferably energized by a DC source such as a battery stored in an apposite compartment 38 within the housing 36. In its simplest form, shown in the schematic drawing of FIG. 4, the control circuit comprises a battery 50 connected to the motor 26 through two switches 52 that control the polarity of the voltage applied to the motor terminals through a microprocessor 53. A suitable microprocessor is the COP842 Processor marketed by the Arrow Electronics Company of Phoenix, Ariz. In the embodiment of the circuit, the switches are preferably placed in the front side of the handles 32, one for each handle (see FIG. 2), so that a user can control the direction of rotation of the shaft by pressing one switch or the other to trigger a roll in either direction. FIG. 6 is a more detailed schematic representation of an electronic circuit implementing the reversible-motor control function with a COP842 microprocessor and standard electronic components. This circuit also provides an audio function to generate noise via a speaker 27 for simulating flight sounds.

Figure 5:
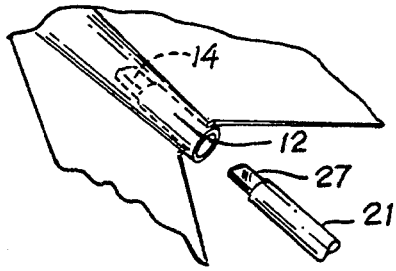
FIG. 5 is an enlarged, partial view of the distal end of the rotating shaft of the invention and of the corresponding conforming channel in the back of the model airplane.

The end of the distal portion 21 of the shaft 20 is designed for releasable engagement with a conforming slotted channel 12 in the back portion of the airplane 10, so that different model airplanes may be installed thereon. The channel is preferably disposed substantially along the longitudinal axis of the airplane, the same axis around planes rotate while performing rolls in flight. The shape of the end 27 of the distal portion 21 of the shaft is chosen to provide lateral engagement with the channel 12, so that the position of the plane 10 remains fixed in relation to the shaft. A suitable design for this feature is a tip 27 in the shape of a blade and a conforming slot 14 at the distal end of the channel 12 (illustrated in FIG. 5). The connection between the shaft 20 and the channel 12 should also be sufficiently snug, either by virtue of friction or a snap-type fit or other equivalent means, to prevent the unwarranted release of the aircraft. On the other hand, the fit should be such that a child can release the plane from the shaft at will and replace it with another model.

Thus, during use the airplane 10 is fixedly attached to the shaft 20 which in turn is rotatably connected to the grip assembly 30. Therefore, the plane can be made to perform rolls around the axis of the shaft 20 simply by causing the shaft to rotate in one direction or the other, as controlled by the switches 52, while the hands of the user remain stationary on the handles 32. This allows a child to imagine that he is piloting the plane through aerobatic maneuvers and dog-fights that require spins and rolls of the craft. Because the shaft is able to spin continuously in the same direction as long as desired, out-of-control dives and tumbles can similarly be mimicked for the playful enjoyment of the child.

Figure 3:
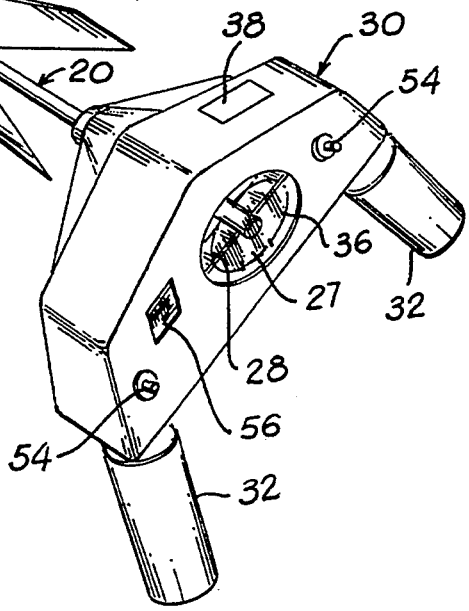
FIG. 3 is an enlarged, cut-out view of the driving mechanism actuating the rotational motion of the shaft of the invention.
Figure 3:
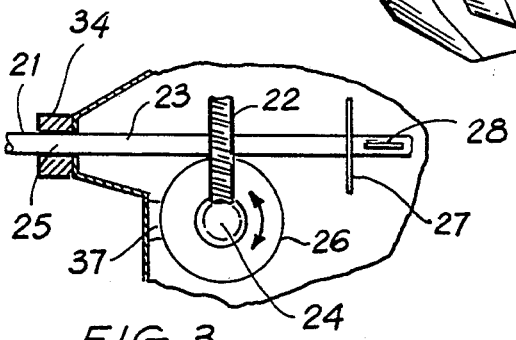

In order to further improve the flight simulating effect of the toy, a bank indicator integral with the shaft 20 may be provided as part of a fictitious flight control panel in the grip assembly 30. Referring particularly to FIG. 3, the proximal portion 23 of the shaft is inserted through a fictitious gauge dial 27 placed perpendicularly near the end of the shaft and a radial pointer 28 (also seen in FIG. 1) is mounted thereon as an indicator for the position of the shaft in relation to reference marks on the dial. By disposing the pointer 28 in coplanar relationship with the craft installed on the shaft 20, the pointer will at all times indicate the degree of roll to which the plane has been subjected. Thus, as the shaft and the airplane connected to it rotate, the pointer follows in either direction, providing an exact position of the plane in relation to an imaginary horizon. Because of the position of the shaft within the grip assembly, this fictitious bank indicator is visible to the child, as she simulates flight conditions, through a transparent window in the back side of the grip housing 36. Thus, the child may imagine to be involved in instrument flights, either in an airplane or a spacecraft, wherein the direction of movement is controlled through the bank indicator.

Additional features may be added to the toy, such as visual or audio signals to simulate projectiles and engine noises. These devices that can also be incorporated in the housing 36 of the grip assembly and be actuated by additional switches 54 within reach of the hands of the user while operating the control grip. For example, a switch 54 could activate a transmitter/receiver unit 56 powered by the battery 50 for communication with an imaginary control tower.

All embodiments described herein may be implemented with any of the materials currently in use for model airplane and toy construction, such as metal, plastic or wood. While the preferred embodiment shown in the figures features the specific shapes therein described, the invention can obviously take other shapes with equivalent functionality and utility. In fact, any shape for any of the components that retains the functional characteristics described above provides an acceptable apparatus to practice the invention. Thus, various changes in the details, steps and materials that have been described may be made by those skilled in the art within the principles and scope of the invention herein illustrated and defined in the appended claims. Therefore, while the present invention has been shown and described herein in what is believed to be the most practical and preferred embodiments, it is recognized that departures can be made therefrom within the scope of the invention, which is not to be limited to the details disclosed herein but is to be accorded the full scope of the claims so as to embrace any and all equivalent apparatus and methods.

I claim:

1. A flight-simulating airplane toy comprising:

(a) a hand-held grip assembly having gripping means adapted to be held by a child;

(b) a straight shaft rotatably mounted on said grip assembly, such that the shaft is capable of clockwise and counterclockwise rotation, said shaft having a forward-projecting distal portion and a proximal portion contained within said grip assembly;

(c) a model aircraft having a back portion that comprises a longitudinal channel adapted to receive and engage said distal portion of the shaft so as to provide a rigid connection between the aircraft and the shaft; and (d) means for alternatively rotating said shaft and the aircraft connected thereto clockwise or counterclockwise, wherein said means for alternatively rotating said shaft and the aircraft connected thereto clockwise or counterclockwise comprises a drive gear fitted coaxially with the shaft, said drive gear being engaged by a tangential continuous worm-screw drive connected to a reversible electric motor, and said electric motor being energized by a power source in an electric circuit controlled by switching means operable by a user.

2. The toy described in claim 1, wherein said power source is a battery.

3. The toy described in claim 1, wherein said switching means consists of two switches disposed on said hand-held grip assembly.

4. The toy described in claim 1, wherein said grip assembly consists of a housing and two handles attached thereto; and wherein said housing has a front side and a back side and comprises a bearing incorporated in the front side for rotatably supporting said shaft.

5. The toy described in claim 4, wherein said power source is a battery.

6. The toy described in claim 4, wherein said switching means consists of two switches disposed on said handles.

7. The toy described in claim 6, further comprising a bank indicator incorporated within said housing of the grip assembly.

8. The toy described in claim 7, wherein said bank indicator consists of a gauge dial positioned coaxially with said proximal portion of the shaft and a pointer mounted radially on the shaft to indicate the position of the shaft in relation to reference marks on the dial, said dial and pointer being visible to a user through a window in the back side of said housing of the grip assembly.

9. The toy described in claim 8, further comprising a transmitter/receiver unit incorporated within said housing of the grip assembly and energized by said power source.

10. A flight-simulating airplane toy comprising:

(a) a hand-held grip assembly having gripping means adapted to be held by a child so that a child user may hold said grip assembly and a toy airplane in elevated position;

(b) a straight shaft rotatably mounted on said grip assembly, such that the shaft is capable of clockwise and counterclockwise rotation, said shaft having a forward-projecting distal portion and a proximal portion contained within said grip assembly;

(c) a model aircraft having a back portion that comprises a longitudinal channel adapted to receive and engage said distal portion of the shaft so as to provide a rigid connection between the aircraft and the shaft; and (d) means for alternatively rotating said shaft and the aircraft connected thereto clockwise or counterclockwise, said shaft rotating means comprising switching means and a drive-gear mechanism actuated by a reversible electric motor energized by a self-contained power source operatively connected within an electric circuit controlled by switching means operable by said a user.

11. The toy described in claim 10, wherein said power source is a battery.

12. The toy described in claim 10, wherein said switching means consists of two switches disposed on said hand-held grip assembly.

13. The toy described in claim 10, wherein said grip assembly consists of a housing and two handles attached thereto, and wherein the toy further comprises a bank indicator incorporated within said housing of the grip assembly.

14. The toy described in claim 13, wherein said bank indicator consists of a gauge dial positioned coaxially with said proximal portion of the shaft and a pointer mounted radially on the shaft to indicate the position of the shaft in relation to reference marks on the dial, said dial and pointer being visible to a user through a window in the back side of said housing of the grip assembly.

15. The toy described in claim 13, further comprising a transmitter/receiver unit incorporated within said housing of the grip assembly and energized by said power source.

* * * * *